United States Patent [19]

Gable

[11] 4,325,240

[45] Apr. 20, 1982

[54] LOCKING MECHANISM

[75] Inventor: Derek J. Gable, Rancho Palos Verdes, Calif.

[73] Assignee: Denis V. Bosley, Rancho Palos Verdes, Calif. ; a part interest

[21] Appl. No.: 76,326

[22] Filed: Sep. 17, 1979

[51] Int. Cl.[3] ..... E05B 37/00

[52] U.S. Cl. ..... 70/284; 70/63; 70/433

[58] Field of Search ..... 70/284, 285, 311, 432, 70/433, 435, 63

[56] References Cited

U.S. PATENT DOCUMENTS

| | | | |
|---|---|---|---|
| 1,389,380 | 8/1921 | Raab | 70/284 |
| 1,937,523 | 12/1933 | Machinist | 70/284 |
| 3,416,337 | 12/1968 | Hutchins | 70/284 |

*Primary Examiner*—Robert L. Wolfe

*Attorney, Agent, or Firm*—Allen A. Dicke, Jr.

[57] ABSTRACT

Locking mechanism has both a key setting multiple tumblers to unique positions and a combination wheel for each tumbler so that opening of the lock requires setting each wheel to correspond to its tumbler position. For a single lock, different keys require different combinations. A mechanical recorder records the wheel positions with each lock opening so that all combinations used for access can be read, if necessary.

24 Claims, 6 Drawing Figures

LOCKING MECHANISM

BACKGROUND

This invention is directed to a locking mechanism which requires both a key and a corresponding combination wheel position to open the locking mechanism. A recorder records the combination wheel setting each time the lock is opened.

One of the types of mechanisms which has been developed to limit access to a designated space is the combination lock. In this case, one or more lock members must be set into an unlocking position by manipulation of one or more manual input elements. The numbered dial is often used, and either one dial is sequentially turned to successive positions or a plurality of dials is each set to a particular position to cause unlocking. The advantage of a combination lock is that a key may be lost or stolen, but a memorized combination is secure until disclosed by the person having the combination.

Another common type of lock is the key lock wherein a specially shaped key is inserted into the lock. The key causes mechanical action in the lock to position tumblers so that the lock is unlocked. Key locks may have a very complicated key-tumbler structure to increase the difficulty of lock-picking. However, loss of the key to another person permits access to the lock-protected space by that person. Furthermore, such keys can and sometimes must be duplicated so that many persons have access, with a greater chance of loss of control. Additionally, when many persons have keys and thus access to protected space, it is not known which of those among the authorized key holders have had access to that space. In order to identify the key user, U.S. Pat. No. 1,253,051 provides a key which has a first set of notches for properly positioning locking tumblers into the unlocked position and has a second set of notches which are peculiar to that key for actuating a recording device for recording which key has been used to open the lock and thus, presumably, identify the key user. However, such a key can be lost, duplicated, or the identifying portion can be altered or defaced to reduce the security of its recording system.

Another type of lock is the key-controlled combination lock. An example of this type of lock is shown in U.S. Pat. No. 3,383,886. In this type of lock, a key is used to unlock the combination dial, and once unlocked, the combination dial then is actuated to unlock the secured space. This type of lock provides the security of having possession of a key and possession of a combination to provide access to the secured space. Thus, loss or duplication of the key does not compromise the space because both knowledge of the combination and possession of the key are necessary for access. When a plurality of persons is permitted access, then the chances of compromise are compounded because the combination can be obtained from one holder and a key from another or by duplication. Furthermore, such a locking structure cannot provide for identification of the user so that, if compromised, that person cannot be identified.

Therefore, there is need of a locking mechanism which can be arranged so that it may be opened by a large number of people, but recording of the user can be achieved. Furthermore, it is desirable to maximize security of such a system by providing a structure wherein each user has two sets of unique information which cooperate together in the locking mechanism to permit access to the secured space and, at the same time, record information related to the user.

SUMMARY

In order to aid in the understanding of this invention, it can be stated in essentially summary form that it is directed to a locking mechanism which has a first input mechanism that is set to a first position unique to that user and also has a second input mechanism which is set to a second position unique to that user. When both mechanisms are set, the positioning of one of them identifies the user, and the related positioning of the two of them permits unlocking so that first and second unique inputs are required of a user for unlocking a lock. Many different keys and combinations are possible for each lock.

Accordingly, it is an object of this invention to provide a locking mechanism which requires first and second inputs, the inputs being unique to the user and related to each other so that, when they are both input into the locking mechanism, the locking mechanism not only is unlocked but records at least one of the unique inputs to identify the lock user. It is another object to provide a locking mechanism where one unique input is a key and the related unique input is a numeral combination so that, when both of them are placed into the lock, the lock is opened and at least one of the unique inputs is recorded. It is a further object to provide a locking mechanism wherein tumblers are positioned by a key and combination wheels are located adjacent to the tumblers so that, when the combination wheels are correctly rotarily positioned, the lock barrel is unlocked for unlocking the mechanism.

It is another object to provide a locking mechanism which is particularly useful for locking a secure space to which access by many different persons is required so that recording of lock opening can be achieved. It is a further object to provide a locking mechanism which is particularly useful for high security controlled areas requiring access by more than one person. Applications include dangerous drug storage or secret files.

Other objects and advantages of this invention will become apparent from a study of the following portion of the specification, the claims, and the attached drawings.

DESCRIPTION OF THE PREFERRED EMBODIMENT

Figure 2:
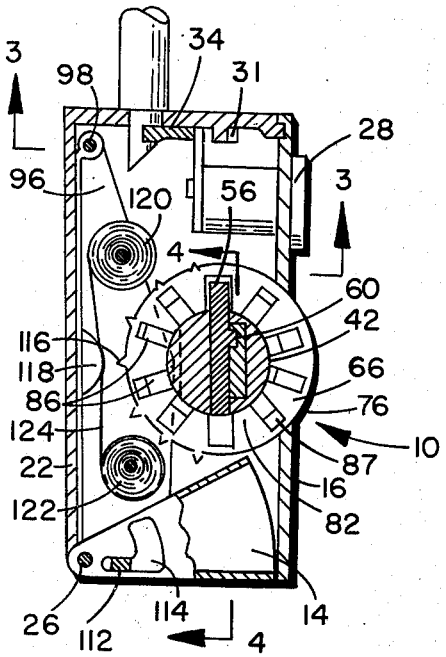
FIG. 2 is an enlarged section taken generally along the line 2—2 of FIG. 1.
Figure 3:
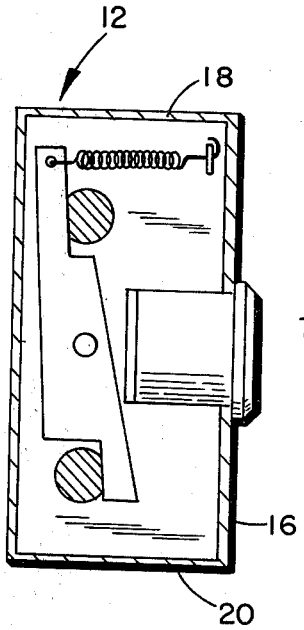
FIG. 3 is a section taken generally along the line 3—3 of FIG. 2.
Figure 1:
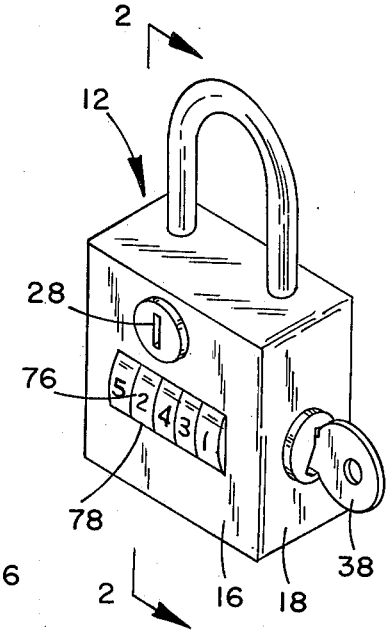
FIG. 1 is an isometric view of a preferred embodiment of the lock and key mechanism of this invention.
Figure 5:
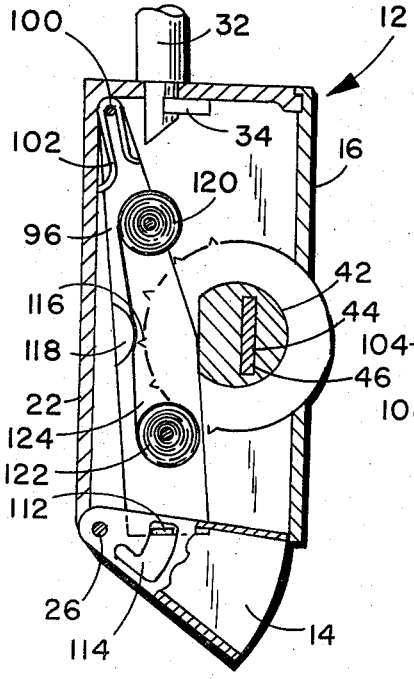
FIG. 5 is a section taken generally along the line 5—5 of FIG. 4.
Figure 4:
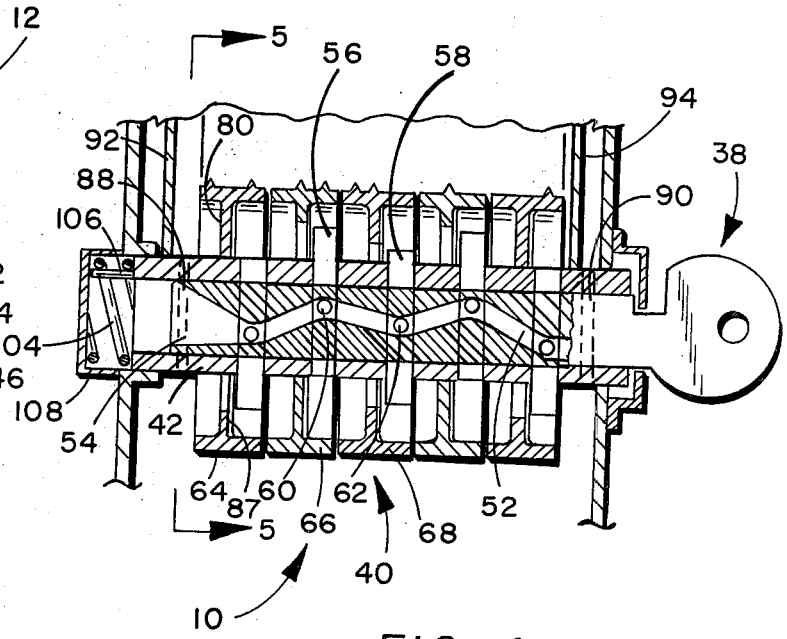
FIG. 4 is a section taken generally along the line 4—4 of FIG. 2.
Figure 6:
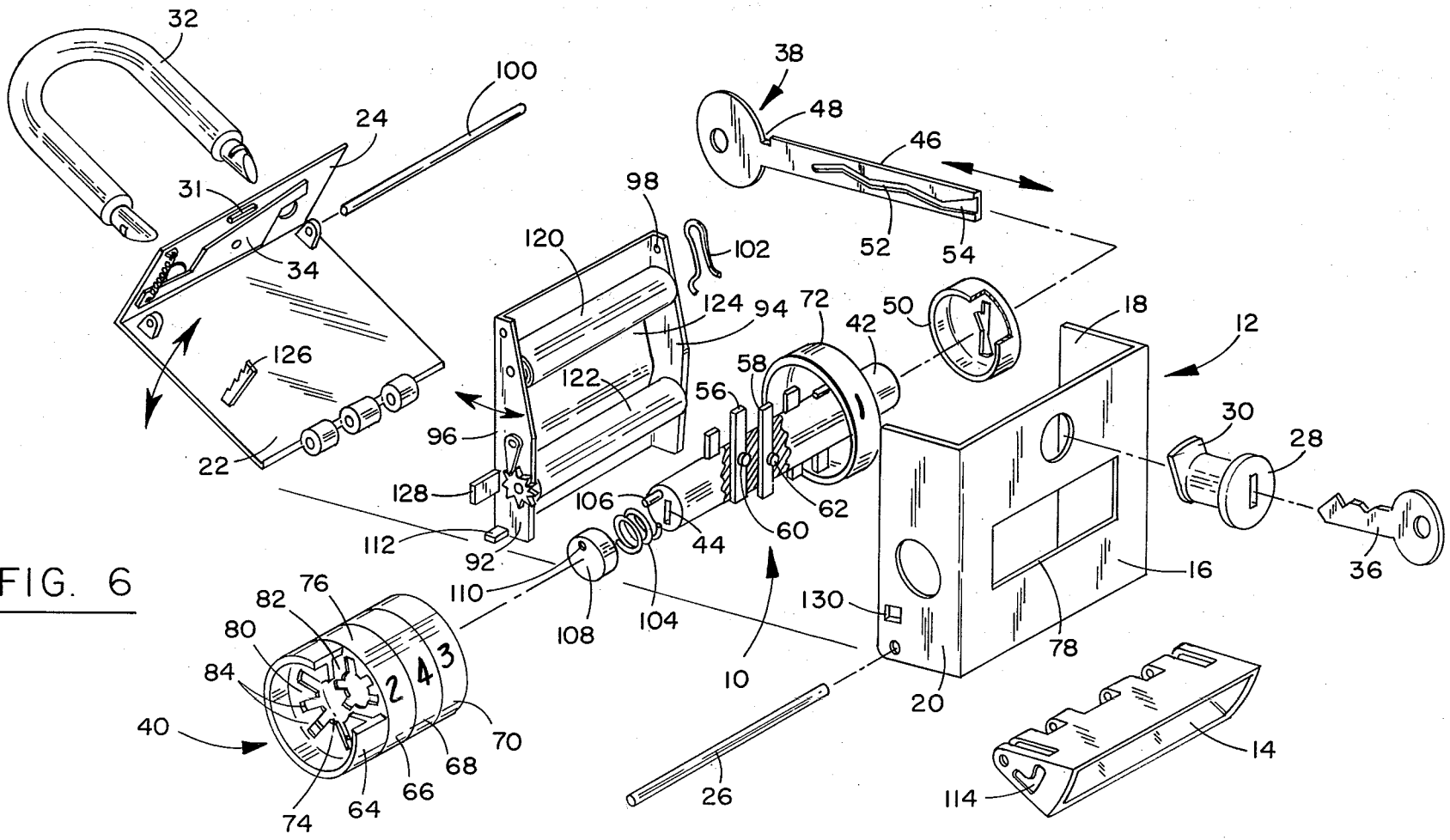
FIG. 6 is an exploded view of a preferred embodiment of the locking mechanism of this invention.

A preferred embodiment of the locking mechanism of this invention is generally indicated at 10 in FIGS. 2, 4 and 6. It is a locking mechanism which can be employed to permit the locking and unlocking of any desired type of restricted space. In the present example, it is associated with lock housing 12 which is arranged to lock and unlock small chamber 14 in the lock housing itself. As seen in FIGS. 1, 2, 5 and 6, lock housing 12 has front 16 integrally formed with sides 18 and 20. Back 22 has top 24 integrally formed therewith. Back 22 is hinged to the sides with hinge pin 26.

As can be seen in FIG. 6, back 22 with its top 24 can be hinged away from the remainder of the lock housing. It can also be swung forward to the closed position and locked in place with separate lock 28. Lock 28 is conventional and has locking flange 30 which engages behind striker plate 31. By unlocking lock 28, the lock housing 12 can be moved from the closed position illustrated in FIGS. 1, 2 and 5 to the open position illustrated in FIG. 6 for access to the interior of lock housing 12. Thereupon, the lock housing can be closed and locked by key lock 28. Hasp 32 has oppositely bevelled tangs which can enter down through holes in top 24. The tangs also carry latching slots therein so that, when the hasp is pushed down through the openings illustrated in FIG. 6, lock plate 34 engages in the slots to hold the hasp in place, see FIGS. 2 and 5. In this way, the lock housing can be locked onto any solid device, such as a doorknob, an eye, or a post. The lock housing can be closed and locked at a central location where the lock use records are maintained and key 36 is kept. It can then be locked in its use location by insertion of hasp 32. By opening lock housing 12 by means of key lock 28, latch plate 34 can be released to release hasp 32 for removal. In this way, lock housing 12 can be secured at any location desired, and the holder of key 36 which operates key lock 28 is the person with access to the interior of the lock housing and can remove the lock housing.

Locking mechanism 10 controls access to chamber 14. When actuated, a recording of the combination used for access is made. The recording mechanism is within lock housing 12 so that the access information is available to the holder of the key 36. While the locking mechanism 10 will be described with respect to access to chamber 14, it is clear that the locking mechanism 10 can be employed for controlling access to and recording access to another chamber.

Locking mechanism 10 requires two separate and related inputs for its actuation. Furthermore, for any first input, the second input which causes opening is unique to that first input. In the illustrated preferred embodiment of the locking mechanism 10 shown in the drawings, the first input to the locking mechanism is presented by key 38, and the second input is presented by combination mechanism 40, see FIGS. 4 and 6. Locking mechanism 10 has barrel 42 in which is formed key slot 44. The key slot is illustrated as being a plane rectangular slot opening, but it may carry therein (on at least one side thereof) particular longitudinal shaping to limit the shape of the key that may be inserted. Key 38 has a shank 46 which can be longitudinally inserted into key slot 44. Shank 46 has a notch 48 which interacts with cup 50 so that key 38 cannot be turned until it is fully inserted. Key shank 46 carries cam groove 52 on the side thereof to act as a tumbler driver. Groove 52 has a wide, funnel-shaped open front end 54 to catch the pins on the tumblers as the key is inserted. The key serves to program the lock and is a first means or program input.

There is a plurality of tumblers of which each is slidably positioned in a tumbler slot which is oriented transversely to key slot 44. Five tumblers and five tumbler slots are shown. Tumblers 56 and 58 are specifically indicated in FIGS. 4 and 6. Tumbler pins 60 and 62 are respectively secured on these tumblers intermediate the ends thereof. The tumbler pins of each of the tumblers extend into key slot 44 to be controlled by cam groove 52. When the key 38 is inserted, the pins on the tumblers are picked up by the funnel-shaped front end 54 of the cam groove, and the tumblers are shifted in accordance with the shape of the cam groove. For convenience of manufacture, the cam groove can be shaped with a particular number of discrete tumbler positions, as is common in tumbler-type locks. For example, there can be five discrete positions of each of the tumblers along its tumbler slot normal to the direction of the insertion. In the present embodiment, it is seen that the tumblers are single-piece and double-ended; that is, they extend out of barrel 42 on both ends of the tumbler in all of the intermediate positions of the tumbler. Since the tumblers are positively driven, no springs are needed, and this reduces the pickability of the lock. Each tumbler must be positively set in its correct tumbler position in order to be in the desired unlocking position. When the key 38 is fully inserted, it can be turned to the right by the agency of notch 48 in the key shank cooperating with the opening in cup 50. This turning of the key does not unlock the mechanism, but permits the next stage of unlocking to be pursued.

Combination mechanism 40 comprises a plurality of combination wheels. Five combination wheels are shown and are indicated at 64, 66, 68, 70 and 72. The combination wheels provide a second input and thus are a second means. Combination wheels 66 and 68 are associated with tumblers 56 and 58. There is the same number of combination wheels as there are tumblers, and one of the tumblers is associated with each of the combination wheels, as is seen in FIG. 4. Each of the combination wheels has an interior hole 74 which engages directly around barrel 42. Each of them has a rim, of which rim 76 of combination wheel 66 is illustrative. The rims extend partly out through an opening at 78 in the front of lock housing 12 so that the rims are manually accessible, see FIGS. 1, 2 and 6. Thus, the lock operator can turn each rim and thus each combination wheel to a selected relative position. Numbers on the rims aid in selecting the desired position, although other types of indicia could alternatively be used. As is seen in FIGS. 2, 4 and 6, each of the combination wheels has a web, with the web 80 of wheel 64 illustrated in FIGS. 4 and 6, and the web of wheel 66 illustrated in FIGS. 2 and 6. Each of the webs of each of the combination wheels 64 through 72 lie adjacent to and on the left side of the tumblers when the locking mechanism 10 is in its locked position, as seen in FIG. 4. Each of the webs has a plurality of slots or radially positioned notches therein, each of the slots being related to a rotary position of the combination wheel and each being related to a particular axial position of its corresponding tumbler. The plural nature of the angularly positioned slots is illustrated in FIGS. 2 and 6 where different pairs of slots are positioned in accordance with the rotary setting of each combination wheel. The plurality of slots in web 80 is generally indicated at 84 in FIG. 6, and the plurality of slots in web 82 is generally indicated at 86 in FIG. 2. The diametrically opposed radial slots in the webs are dimensioned so that their ends are spaced apart just slightly longer than the length of the corresponding tumbler. Thus, when each combination wheel is properly angularly positioned with the proper indicia showing, than a slot (second member) of particular dimensional position is arranged adjacent a tumbler (first member) having a particular position. Blind shallow recesses of differing depths such as shown at 87 in FIGS. 2 and 4 are provided in the shape of tumblers at all angular positions of the wheels. This renders it impossible to "pick" the lock using a key for which the corresponding combination is not known, as for instance in the case of a key being found by an unauthorized person. Any attempt to pick the lock by loading the wheel with the key and testing for stiffness (which would indicate a wrong position) would be foiled because different recesses would "feel" like a correct wheel setting.

When all of the tumblers are arranged in a particular position as required (first means) by key 38 and each of the combination wheels (second means) is properly angularly set, then the tumblers are each lined up in the preselected position with a slot through a web at the same position. Now, barrel 42 can move to the left from the locked position of FIG. 4 to an unlocked position. In the unlocked position, movement of the barrel to the left places grooves 88 and 90 in the barrel adjacent side plates 92 and 94 on latching frame 96. Latching frame 96 is pivoted at 98 onto the pin 100 on back 22, see FIGS. 2 and 6. Spring 102 urges latching frame 96 toward the unlocked position.

As previously noted, notch 48 prevents turning of key 38 until it is fully inserted. Spring 104 urges barrel 42 to the right toward the unlocking position but, in order to prevent the moving tumblers from engaging upon the webs during key insertion (possibly by overcoming the force of spring 104), pin 106 (see FIG. 4) engages on the inside of cap 108 to take up the thrust until the key is fully inserted. After full insertion, cup 50 permits clockwise turning of key 38 through a small angle, for example 45 degrees, so that pin 106 lines up with aperture 110 in cap 108. In this orientation, with the combination wheels turned to the correct position, further thrust on key 38 moves the barrel 42 to the left in FIG. 4 to the unlocked position. When the unlocked position is reached, latching frame 96 swings forward.

As is seen in FIGS. 2, 5 and 6, latching frame 96 has sear 112 on its bottom. In FIG. 2, latching frame 96 is shown in its locked position wherein sear 112 is in the narrow portion of slot 114 to hold small chamber 14 in the raised position. When latching frame 96 swings to the unlocked position of FIG. 5, sear 112 is in the large part of slot 114 to permit the descent and opening of small chamber 14, as is shown in FIG. 5. In this way, small chamber 14 is unlocked and opened.

The swinging forward of latching frame 96 from the locked to the unlocked position, in addition to opening small chamber 14, also records the position of the combination wheels. Hence, a sequential record of the position of the combination wheels as the lock is opened is maintained which can be used to trace the persons who were issued those combinations. Recording is accomplished by projections 116 on the periphery of the combination wheels. The projections are patterned so that a specific pattern represents a specific angular orientation of each combination wheel. The projections face press pad 118 which is secured to locking frame 96. Supply roll 120 and takeup roll 122 feed film-like recording medium 122 across press pad 118. Pawl 126 on back 122 in cooperation with a ratchet wheel on takeup roll 122 causes advance of the recording medium each time latching frame 96 swings from the unlocked position to the locked position. Thus, each key provides a different program and the sequence of use is recorded. Takeup roll 122 with its sequentially recorded information is available to the holder of key 36.

In locking up, first chamber 14 must be closed. Reset lever 128, see FIG. 6, extends out of window 130 in the side of the lock housing. Reset lever 128 is manually engaged to swing latching frame 96 rearward to lock small chamber 14. Swinging latching frame 96 back also pulls side plates 92 and 94 out of grooves 88 and 90 so that barrel 42 can move to the right under the force of spring 104. This also pulls pin 106 out of aperture 110 so that key 38 can be turned to the upright position to remove notch 48 from the constraints of cup 50 so that key 38 can be withdrawn. Thus, key 38 can only be withdrawn when the secured chamber (small chamber 14) is again closed.

From this description, it can be seen that locking mechanism 10 can be unlocked with a plurality of keys 38 each having a different shape of cam grooves 52, providing that the corresponding positioning of the combination mechanism is achieved at the same time. Thus, different key shapes of key 38 can be distributed to different potential users of the secured or controlled space, and, with each key 38, a corresponding combination is provided. Thus, each unique key has a unique combination by which the locking mechanism can be unlocked. For security purposes, it is desirable to employ a key and a combination in conjunction with each other, for a key can be lost or stolen but, without the combination, cannot be employed. Furthermore, a combination can become compromised, but without the corresponding key, it cannot unlock the secured space. For this reason, the described mechanism is the preferred embodiment. However, the structure could be arranged with first and second combinations, the first uniquely setting a first portion of the mechanism, and the second uniquely unlocking the locking mechanism from that position. Similarly, two keys could be employed, the first uniquely setting the first portion of the mechanism and the second uniquely unlocking the mechanism from that position. Thus, first and second unique inputs permit recording of the lock user. Furthermore, while the locking mechanism is described in conjunction with a small secure chamber 14, it is clear that the swinging of the locking frame 96 can secure and release other types of secure chambers. In a real estate sales operation, a door key to a house for sale can be stored in chamber 14, and each real estate person can have a unique key 38 and a unique combination. By requiring two inputs to the locking mechanism and by recording each combination used, security is enhanced.

This invention has been described in its presently preferred mode, and it is clear that it is susceptible to numerous modifications and embodiments within the ability of those skilled in the art and without the exercise of the inventive faculty. Accordingly, the scope of this invention is defined by the scope of the following claims.

What is claimed is:

1. A locking mechanism comprising:

a tumbler;

means for moving said tumbler to one of a plurality of predetermined positions;

a web;

a plurality of cooperative means in said web each for cooperating with said tumbler, each one of said cooperative means within said web being positionable to receive said tumbler when said tumbler is correctly positioned by said tumbler moving means;

means for controlling the position of said web because positioning of both said cooperative means on said web and said tumbler is necessary for said tumbler to be received by said cooperative means so that said locking mechanism can be unlocked.

2. A locking mechanism comprising:

a tumbler;

a plurality of means each for moving said tumbler to each one of a number of predetermined positions;

a web;

a plurality of cooperative means in said web each for cooperating with said tumbler, each one of said cooperative means within said web being positionable to receive said tumbler when said tumbler is correctly positioned by each one of a plurality of said tumbler moving means;

means for controlling the position of said web whereby positioning of both said cooperative means on said web and said tumbler is necessary for said tumbler to be received by said cooperative means so that said locking mechanism can be unlocked; and recording means in said locking mechanism for recording the position of said web or said tumblers.

3. The locking mechanism of claim 1 wherein there is a plurality of tumblers, a corresponding plurality of webs and a number of tumblers positioning means, each for moving said plurality of tumblers into different combinations of positions.

4. The locking mechanism of claim 2 wherein there is a plurality of tumblers, a corresponding plurality of webs and a number of tumblers positioning means, each for moving said plurality of tumblers into different combinations of positions.

5. The locking mechanism of claim 4 wherein said webs are each a portion of a combination wheel so that positioning of said combination wheels causes positioning of said webs.

6. The locking mechanism of claim 5 wherein said tumbler positioning means is a key having a shaped surface thereon, each of said tumblers being positioned in accordance with the shaped surface when said key is in its operating position.

7. A locking mechanism comprising:

a plurality of tumblers;

a key having a shaped surface thereon, each of said tumblers being positioned in accordance with the shaped surface when said key is in its operating position;

a plurality of webs corresponding in number to the plurality of tumblers, each of said webs being a portion of a combination wheel so that positioning of said combination wheels causes positioning of said web;

a plurality of cooperative means in each said web for cooperation with its corresponding tumbler, each one of said cooperative means within said web being positionable to receive said tumbler when said tumbler is correctly positioned by its key;

a lock barrel and a longitudinal key slot in said lock barrel, said key slot being for receiving said tumbler positioning key, said tumblers being movable transversely to said key slot, said lock barrel extending through said webs, said cooperating means on each of said webs being tumbler slots, each of said webs having a particular tumbler slot for passing a tumbler when it is positioned by a particular key so that said barrel is permitted to longitudinally move when said webs are positioned as required by the tumbler positions established by a particular key so that said locking mechanism can be unlocked; and recording means in said locking mechanism for recording the positions of said webs or of said tumblers.

8. A locking mechanism comprising:

a movable member, said movable member being movable from a first position in which said locking mechanism is locked to a second position wherein said locking mechanism is unlocked;

a tumbler associated with said movable member, said tumbler being movable to a plurality of selected positions;

a web associated with said tumbler, said web having a plurality of differently positioned notches therein, there being among said plurality of notches two notches defining a space positioned to receive said tumbler when it is in one of its positions, and restraining said tumbler from being received in a space when a wrongly positioned space in said web is adjacent said tumbler to restrain said member from moving from its first position to its second position;

means for positioning said tumbler; and means for positioning said web so that the positioning of said web is dependent upon the positioning of said tumbler for unlocking said locking mechanism so that a unique position of said web is required for a unique position of said tumbler caused by said tumbler positioning means.

9. The locking mechanism of claim 8 wherein there is a plurality of tumblers, a web associated with each of said tumblers and a number of tumbler positioning means, each for moving said plurality of tumblers into different combinations of positions.

10. The locking mechanism of claim 9 wherein there is a recording mechanism for recording the unique position of said tumblers or said webs so that unique identification of access is provided.

11. A locking mechanism comprising:

a movable member, said movable member being movable from a first position in which said locking mechanism is locked to a second position wherein said locking mechanism is unlocked;

a plurality of tumblers associated with said movable member, each said tumbler being movable to a plurality of selected operating positions;

a web associated with each said tumbler, each said web having a plurality of differently positioned notches thereon, there being among said plurality of notches two notches defining a space positioned to receive said tumbler when said tumbler is in one of its preselected operating positions, and restraining said tumbler from being received in a space when a wrongly positioned space in said web is adjacent said tumbler;

means for positioning said tumblers; and means for positioning said webs, said tumblers and said webs together comprising cooperative means for permitting unlocking motion of said member from said first position to said second position; and recording means in said locking mechanism for recording the position of at least some of said cooperative means or some of said tumblers when said locking mechanism is unlocked.

12. The locking apparatus of claim 11 wherein said movable member is a lock barrel and there is a key slot in said lock barrel, said tumblers being movably mounted with respect to said lock barrel and being positioned with respect to said lock barrel with a key.

13. The lock mechanism of claim 12 wherein said webs embrace said lock barrel and are mounted for rotation around said lock barrel so that said webs can be rotated to position said notches therein with respect to said tumblers to permit axial motion of said lock barrel from said first position to said second position.

14. The locking mechanism of claim 13 wherein there is at least one groove in the side of said lock barrel and there is a movable latching frame in said locking mechanism, said latching frame being movable into and out of said groove to provide unlocking motion.

15. The locking mechanism of claim 14 wherein said recording means is actuated by said latching frame.

16. The locking mechanism of claim 15 wherein said recording mechanism is mounted on said latching frame and is moved from a nonrecording position wherein said latching frame is out of said groove in said lock barrel to a recording position wherein said latching frame is engaged in said groove in said locking barrel.

17. The locking mechanism of claim 16 wherein there is at least one combination wheel and said webs are positioned by positioning said combination wheel, the position of said webs being recorded by said recording means.

18. The locking mechanism of claim 17 wherein there are shallow recesses of differing depths extending outwardly beyond at least some of said notches so that a tumbler positioned away from its correct position enters the recess when the key is pushed inwards so that different wrongly positioned tumblers will touch the bottoms of said recesses for different incorrect wheel positions.

19. A locking mechanism comprising:

a movable member, said movable member being movable from a first position in which locking mechanism is locked to a second position wherein said locking mechanism is unlocked;

a tumbler associated with said movable member, said tumbler being movable to a plurality of selected operating positions;

a web associated with said tumbler, said web having a plurality of differently positioned notches therein, there being among said plurality of notches two notches defining a space positioned to receive said tumbler when said tumbler is in one of its operating positions, and restraining said tumbler from being received in a space when a wrongly positioned space in said web is adjacent said tumbler to restrain said member from moving from its first position to its second position, said web further having shallow recesses of differing depths extending outwardly beyond at least some of said notches so that a tumbler positioned away from its correct position enters the recess when said movable member is urged from a first position towards a second position so that different tumblers will touch the bottoms of said recesses for different incorrect web positions;

means for positioning said tumbler; and means for positioning said web so that the positioning of said web is dependent upon the positioning of said tumbler for unlocking said locking mechanism so that a unique position of said web is required for each position of said tumbler caused by said tumbler positioning means.

20. A locking mechanism comprising:

a first member;

a second member, said first and second members cooperating with each other so that when said first and second members are in a preselected position with respect to each other said locking mechanism is unlocked and when said first and second members are away from the preselected position said locking mechanism is locked;

first means connected to said first and second members and second means connected to said first and second members for controlling the relative position of said first and second members with respect to each other so that for any unique position of said first means there is a corresponding unique position of said second means wherein said first and second members are in the preselected position so that said locking mechanism is unlocked.

21. The locking mechanism of claim 20 further including recording means in said locking mechanism for recording the position of one of said means when said locking mechanism is in the unlocked position.

22. A locking mechanism comprising:

a first member;

a second member, said locking means being in an unlocked condition when said first and second members are in a preselected relative position and when said locking mechanism is a locked condition when said first and second members are away from the preselected relative position;

first means connected to said first and second members for programming said locking mechanism by moving said first means to one of a plurality of unique positions; and second means connected to said first and second members for moving said first and second members relative to each other to one of a plurality of unique positions one of which corresponds to the correct unique position wherein said first and second members are in the preselected position wherein said locking mechanism is unlocked so that there is a different correct position for said second means for each differently programmed position of said first means to relatively position said first and second members to the unlocked preselected position.

23. The locking mechanism of claim 22 further including recording means in said locking means for recording the position of one of said first and second means.

24. A locking mechanism comprising:

a first member;

a second member, said locking means being in an unlocked condition when said first and second members are in a correct relative position and said locking mechanism is in a locked condition when said first and second members are away from the correct relative position;

first means connected to said first member for programming said locking mechanism by moving said first member to one of a plurality of unique positions, said first means comprising a key having a longitudinally oriented shank, at least one cam groove on the side of said key shank, said first member being positioned to one of its plurality of unique positions by said cam groove when said key is in programming position; and second means connected to said second member for moving said second member relative to said first member to one of a plurality of unique positions, one of which corresponds to the correct unique position wherein said first and second members are in the correct relative position wherein said locking mechanism is unlocked so that there is a different correct position for said second means for each said position of said first means programmed by said key, to relatively position said first and second members to the unlocked position.

* * * * *

UNITED STATES PATENT AND TRADEMARK OFFICE

CERTIFICATE OF CORRECTION

PATENT NO. : 4,325,240

DATED : April 20, 1982

INVENTOR(S) : DEREK J. GABLE

It is certified that error appears in the above-identified patent and that said Letters Patent is hereby corrected as shown below:

Column 10, line 37, "means" should read --member--.

Signed and Sealed this

*Eleventh* Day of *December 1984*

[SEAL]

*Attest:*

GERALD J. MOSSINGHOFF

*Attesting Officer*

*Commissioner of Patents and Trademarks*